US009316023B2

(12) United States Patent
Lundberg

(10) Patent No.: US 9,316,023 B2
(45) Date of Patent: Apr. 19, 2016

(54) CYLINDER BODY FOR A CYLINDER FOR LOCKS

(71) Applicant: DORMA Deutschland GmbH, Ennepetal (DE)

(72) Inventor: Lars Lundberg, Västra Frölunda (SE)

(73) Assignee: DORMA DEUTSCHLAND GMBH (DE)

( * ) Notice: Subject to any disclaimer, the term of this patent is extended or adjusted under 35 U.S.C. 154(b) by 0 days.

(21) Appl. No.: 14/833,776

(22) Filed: Aug. 24, 2015

(65) Prior Publication Data

US 2016/0060901 A1 Mar. 3, 2016

(30) Foreign Application Priority Data

Aug. 26, 2014 (DE) ..... 10 2014 112 218

(51) Int. Cl.

| | |
|---|---|
| ***E05B 27/06*** | (2006.01) |
| ***E05B 27/00*** | (2006.01) |
| *E05B 29/00* | (2006.01) |
| *E05B 47/00* | (2006.01) |

(52) U.S. Cl.

CPC ..... *E05B 27/0017* (2013.01); *E05B 27/0082* (2013.01); *E05B 29/0066* (2013.01); *E05B 47/0044* (2013.01); *Y10T 70/7057* (2015.04); *Y10T 70/7616* (2015.04); *Y10T 70/7904* (2015.04)

(58) Field of Classification Search

CPC ..... E05B 21/066; E05B 27/0082; E05B 29/0066; E05B 27/0017; E05B 47/0044; E05B 47/0045; E05B 29/0013; E05B 29/0033; Y10T 70/7616; Y10T 70/7057; Y10T 70/7904

USPC ..... 70/358, 366, 495, 276, 413, 493, 494

See application file for complete search history.

(56) References Cited

U.S. PATENT DOCUMENTS

| | | | | | |
|---|---|---|---|---|---|
| 408,147 | A | * | 7/1889 | Taylor | E05B 17/04 70/366 |
| 1,892,419 | A | * | 12/1932 | Best | E05B 27/0007 70/375 |
| 2,857,753 | A | * | 10/1958 | Biro | E05B 27/0042 70/378 |
| 3,035,433 | A | * | 5/1962 | Testa | E05B 29/00 70/409 |
| 3,656,328 | A | * | 4/1972 | Hughes | E05B 19/0023 70/276 |
| 3,768,284 | A | * | 10/1973 | Kent | E05B 15/1614 70/104 |
| 3,928,992 | A | * | 12/1975 | Talbot | E05B 29/0013 70/276 |
| 4,026,134 | A | * | 5/1977 | Woolfson | E05B 47/0044 70/276 |
| 4,380,163 | A | * | 4/1983 | Reder | E05B 27/0064 70/378 |
| 4,545,224 | A | * | 10/1985 | Zane | E05B 71/00 70/233 |
| 4,651,546 | A | * | 3/1987 | Evans | E05B 21/066 70/366 |
| 5,079,936 | A | * | 1/1992 | Stefanek | E05B 27/00 70/358 |

(Continued)

FOREIGN PATENT DOCUMENTS

DE 10220078 * 3/2004

*Primary Examiner* — Lloyd Gall

(74) *Attorney, Agent, or Firm* — Cantor Colburn LLP

(57) ABSTRACT

A cylinder body for a cylinder for locks, including at least a first pin channel and a second pin channel for guiding body pins and at least one third pin channel for guiding a locking bar of a cylinder core.

7 Claims, 4 Drawing Sheets

(56) References Cited

U.S. PATENT DOCUMENTS 5,293,764 A * 3/1994 Guzzinati ..... E05B 29/002 70/365
5,475,997 A * 12/1995 Chung ..... E05B 27/001 70/358
5,582,050 A * 12/1996 Haggstrom ..... E23C 3/35 409/132
5,613,389 A * 3/1997 Hauser ..... E05B 29/0013 70/366
6,041,631 A * 3/2000 Vonlanthen ..... E05B 29/00 70/413
6,079,240 A * 6/2000 Shvarts ..... E05B 9/084 70/367
6,477,876 B1 * 11/2002 Kim ..... E05B 27/0078 70/409
6,584,819 B1 * 7/2003 Hung ..... E05B 27/083 70/358
6,776,017 B2 * 8/2004 Herdman ..... E05B 29/0013 70/338
6,826,936 B1 * 12/2004 Ming-Er ..... E05B 29/0013 70/353
6,910,356 B2 * 6/2005 Price ..... E05B 15/1614 70/358
7,673,484 B1 * 3/2010 Crepinsek ..... E05B 17/14 70/358
9,038,427 B2 * 5/2015 Shen ..... E05B 27/0075 70/358
2002/0116968 A1 * 8/2002 Shvarts ..... E05B 9/084 70/370
2015/0184422 A1 * 7/2015 Chang ..... E05B 29/0066 70/357

* cited by examiner

CYLINDER BODY FOR A CYLINDER FOR LOCKS

CROSS REFERENCE TO RELATED APPLICATION

This application is related to and claims the benefit of German Patent Application Serial Number 102014112218.6 filed on 26 Aug. 2014, the contents of which are herein incorporated by reference in their entirety.

TECHNICAL FIELD

The present invention regards a cylinder body for a cylinder for locks. Further, the invention concerns a lock comprising said cylinder body.

BACKGROUND

Locks are commonly used to only allow authorized persons entering a door. Such authorized persons use a key to unlock the door such that the door can be opened. In the other way, the door can be kept in a closed state by locking the door with the key. In the global market, three main concepts of locks are provided. First, there is the Yale concept, in which the key has a saw tooth structure. Second, there are known dimple keys which have drilled holes or milled slots in the key body. Finally, there are known disk cylinder concepts, in which a key is used to rotate disks to different angles such that cut-outs within the disks are aligned. Due to these three concepts, lock manufacturers have the disadvantage that a lot of components for the cylinder housing need to be provided. These components differ for each concept. Further, there have to be provided different cylinder components for each cylinder type based on local or global standards as well as on local or global adaptations to required special functions. Finally, there is a disadvantage in that there are huge costs for stocking of components and manufacturing the different types of locks.

BRIEF SUMMARY

A cylinder body is provided for a lock which is easy to manufacture and which can be used in a very flexible way.

More specifically, a cylinder body is provided comprising at least a first pin channel, a second pin channel, and a third pin channel. The first pin channel and the second pin channel are provided for guiding body pins, while the third pin channel is provided for guiding a locking bar of a cylinder core. Within the cylinder body, any cylinder core can be provided. For providing the cylinder core, the cylinder body comprises said three pin channels. Therefore, the cylinder body can house different types of cylinder cores. The first and the second pin channel are provided for guiding body pins. Therefore, these pin channels can be used in connection with the Yale key ("Saw tooth keys") concept and the dimple key concept. The third pin channel is provided for an optional third locking option of the cylinder, either by a locking bar or by lateral pins. Therefore, this channel can be used with the dimple key concept. Instead of locking thru a locking bar, the third pin channel could also be used for locking by further body pins. This allows to house cylinder cores having three different rows of cylinder pins. Due to the possibility to employ different cylinder cores, the inventive cylinder body can be used in a very flexible way. A lot of different locks can be produced for different requirements. It is advantageous that only one type of cylinder body needs to be provided with all the different types of locks.

In a preferred embodiment, the first pin channel and the second pin channel are provided in parallel to each other. This allows to provide a cylinder core having two rows of core pins to provide a redundant system. In case the one row of core pins or body pins is damaged, the lock comprising the cylinder body can still keep the door in a closed state because there is a remaining row of pins.

Further, the first pin channel is preferably provided symmetric to the cylinder body, while the second pin channel is provided asymmetric to the cylinder body. In a preferred embodiment, the cylinder body has a square section comprising a round portion and an elongated portion. The round portion is provided for guiding the cylinder core. The first pin channel and the second pin channel are preferably provided within the elongated portion. In this preferred embodiment, the first pin channel is provided symmetric, i.e. in the middle of the elongated section, while the second pin channel is provided on the left-hand side or the right-hand side of the first pin channel, i.e. asymmetric to the elongated section. This allows an optimal placement of the different body pins.

Further, it is advantageous to provide the third pin channel perpendicular to the first pin channel and/or the second pin channel. In case the first pin channel and the second pin channel are provided in parallel to each other, the third pin channel is provided perpendicular to both, the first pin channel and the second pin channel. This allows the cylinder core to be further secured against unallowed rotation. In case a person tries to break the lock comprising said cylinder body, pins being orientated perpendicular to each other have to be broken. Therefore, the effort to destroy such a lock is increased. This results in a very secure kind of lock.

Preferably, the cylinder body comprises a fourth pin channel for guiding a magnetic pin. The magnetic pin is a security function against illegal key copying. The blocking function of such a magnetic pin can only be neutralized with a key having the correct magnetic code. In a preferred embodiment, the magnetic pin can be replaced by floating elements or other additional arrangements. The fourth pin channel is preferably orientated perpendicular to the first pin channel and/or the second pin channel or is provided in parallel to the third pin channel.

The invention additionally regards a lock comprising the above described cylinder body. Further, the lock comprises a replaceable cylinder core which is provided within the cylinder body. The cylinder core has at least one row of core pins aligning with the first pin channel and/or the second pin channel and/or the third pin channel and/or the fourth pin channel. Since there are at least three different pin channels, in a preferred way four pin channels, provided with the cylinder body, a lot of different cylinder cores can be used for the lock. This allows a very flexible setup of the lock, while in all versions of the lock the same cylinder body can be employed. This allows providing a high number of different lock types for cheap costs. Preferably, the cylinder core provided within the cylinder body can also comprise a locking bar which is guided within the third pin channel.

It is advantageous to provide a lock having a cylinder core, wherein the cylinder core comprises at least one first row of core pins aligning with the first pin channel. Additionally or alternatively, the cylinder core comprises at least one second row of core pins aligning with the second pin channel. Further, it is preferably if the cylinder core comprises, additionally or alternatively, a locking bar aligning with the third pin channel.

The lock preferably also comprises a cylinder core, which has a disk cylinder and/or a pin cylinder. The disk cylinder includes the locking bar, while the pin cylinder includes the first row of core pins and/or the second row of core pins. In a preferred embodiment, the cylinder core comprises both, the disk cylinder and the pin cylinder. Therefore, a hybrid lock is provided which requires a hybrid key top operate the cylinder core. Such a lock secures a door in an optimal manner.

A lock having a cylinder core comprising both, the disk cylinder and the pin cylinder, preferably comprises a coupling. The coupling is provided between the disk cylinder and the pin cylinder. Since the disk cylinder needs to be rotated in order to allow unlocking and the pin cylinder only needs an inserted key to allow unlocking, the coupling is provided to allow rotation of the pin cylinder while the disk cylinder remains without any movement. After rotation of a predetermined value, the pin cylinder is rotated together with the disk cylinder. In a preferred embodiment, said predetermined value is about 20 degrees.

BRIEF DESCRIPTION OF THE DRAWINGS

In the following, preferred exemplary embodiments of the invention are explained with the reference to the drawings. In the drawings.

DETAILED DESCRIPTION

Figure 1:
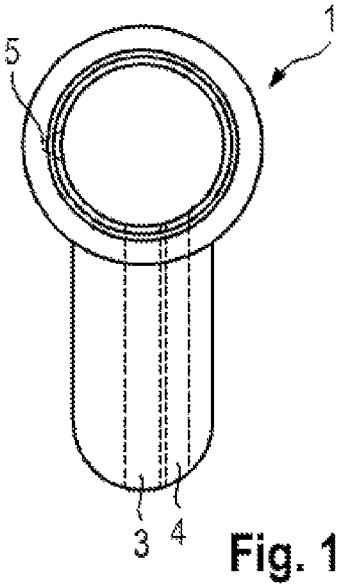
FIG. 1 is a schematic drawing showing an exemplary embodiment of the cylinder body according to the invention.

FIG. 1 shows a cylinder body 1 according to an exemplary embodiment of the present invention. The cylinder body 1 can be used for providing a lock 2 (cf. FIGS. 3 and 4) with different kinds of cylinder cores (cf. FIG. 2). In order to be able to house different kinds of cylinder cores, the cylinder body 1 comprises a first pin channel 3, a second pin channel 4, and a third pin channel 5.

As can be seen from FIG. 1, the square section of the cylinder body 1 comprises a round portion and an elongated portion. The first pin channel 3 and the second pin channel 4 are provided within the elongated portion, while the third pin channel 5 is provided within the round portion. The first pin channel 3 and the second pin channel 4 are provided in parallel to each other, while the third pin channel 5 is provided perpendicular to the first pin channel 3 and the second pin channel 4. Further, the first channel 3 is provided symmetric to the cylinder body 1, while the second pin channel 4 is provided on the right-hand side of the first pin channel 3 and is therefore provided asymmetric to the cylinder body 1. The third pin channel 5 allows guidance of a blocking bar of a cylinder core. Alternatively, the third pin channel 5 allows guidance of another set of pins.

Figure 2:
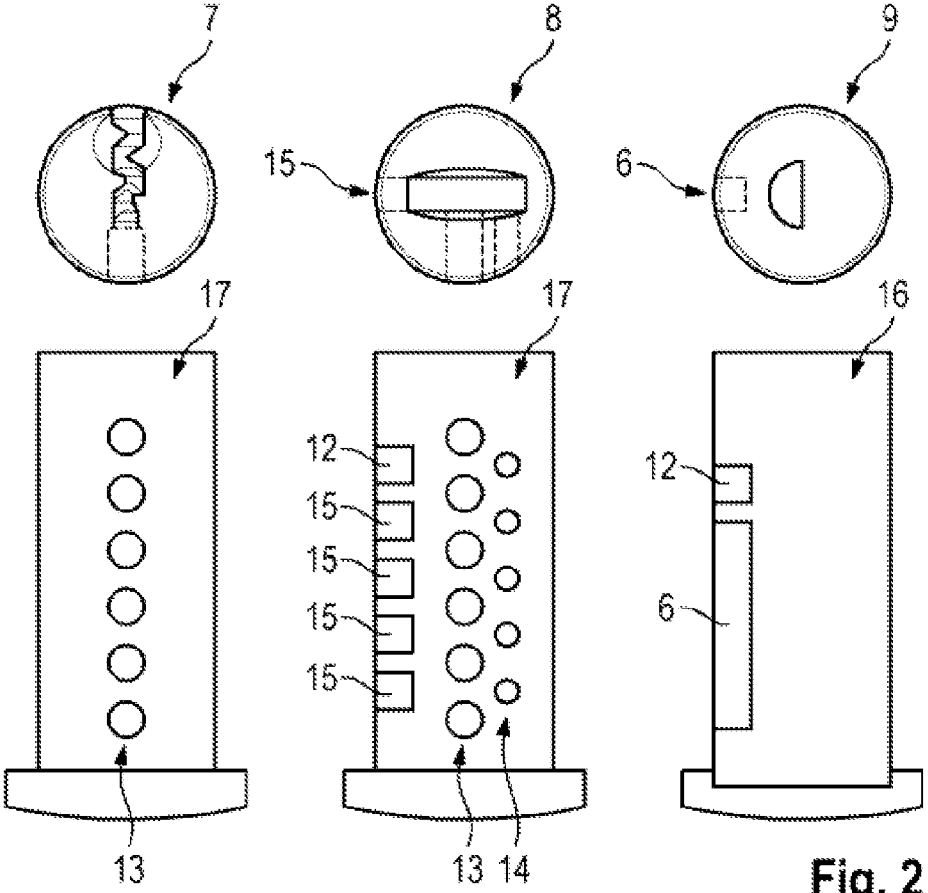
FIG. 2 is a schematic drawing showing three different types of cylinder cores which can be used in an exemplary embodiment of the lock according to the invention.

FIG. 2 shows three different embodiments of cylinder cores 7, 8, 9, which can be used within the cylinder body 1 of FIG. 1 in order to provide a lock 2. The first cylinder core 7 follows the Yale concept. Therefore, a first core pin row 13 is provided within a pin cylinder 17 of the first cylinder core 17. In case the first cylinder core 7 is provided within the cylinder body 1, the first core pin row 13 aligns with the first pin channel 3. Therefore, the pin cylinder 17 cannot be rotated as long as pins are guided within both, the cylinder body 1 and the pin cylinder 17 of the first cylinder core 7.

A second cylinder core 8 comprises a first core pin row 13, a second core pin row 14 and a third core pin row 15. Further, the second cylinder core 8 comprises a magnetic pin 12. In case the second cylinder core 8 is provided within the cylinder body 1, the first core pin row 13 aligns with the first pin channel 3, the second core pin row 14 aligns with the second pin channel 4, and the third core pin row 15 aligns with the third pin channel 5. The magnetic pin 12 aligns with a fourth pin channel 11. In order to rotate the pin cylinder 17 of the second cylinder core 8, three different rows of core pins have to be adjusted. Additionally, the magnetic pin 12 has to be unlocked. Therefore, the second cylinder core 8 provides a very safe and secure lock. The second cylinder core 8 follows the dimple key concept.

A third cylinder core 9 is provided according to the disk cylinder type concept. The disk cylinder type concept only comprises a locking bar 6. The locking bar 6 is aligned with the third pin channel 5. Therefore, the locking bar 6 can block rotation of a disk cylinder 16 of the third cylinder core 9. Additionally, the third cylinder core 9 comprises a magnetic pin 12 which aligns with the fourth pin channel 11.

Figure 3:
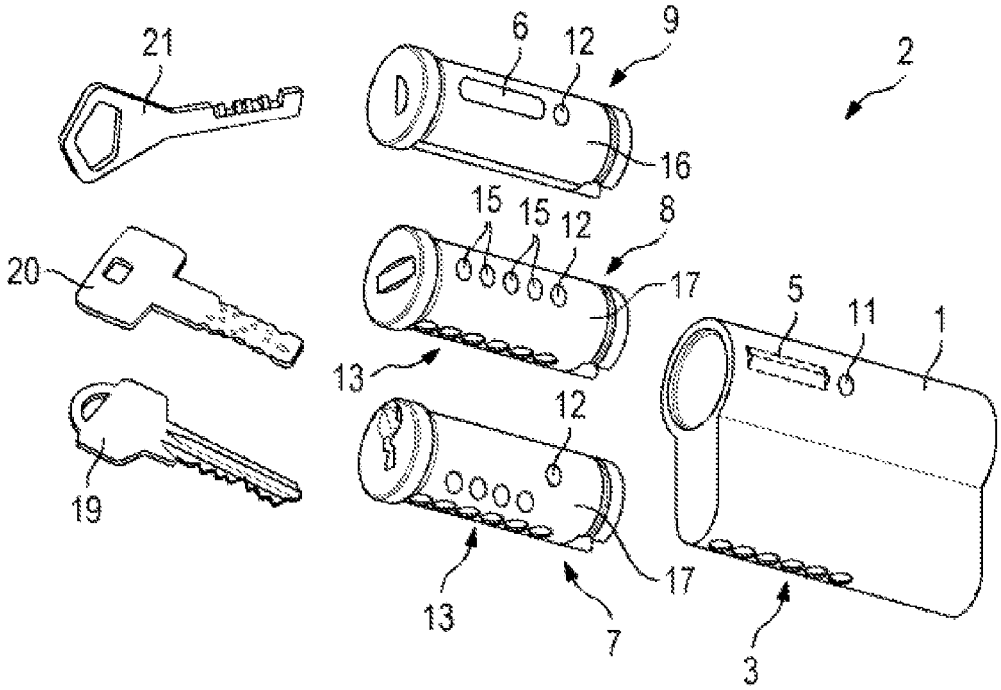
FIG. 3 is a schematic drawing showing three exemplary embodiments of the lock according to the invention.
Figure 4:
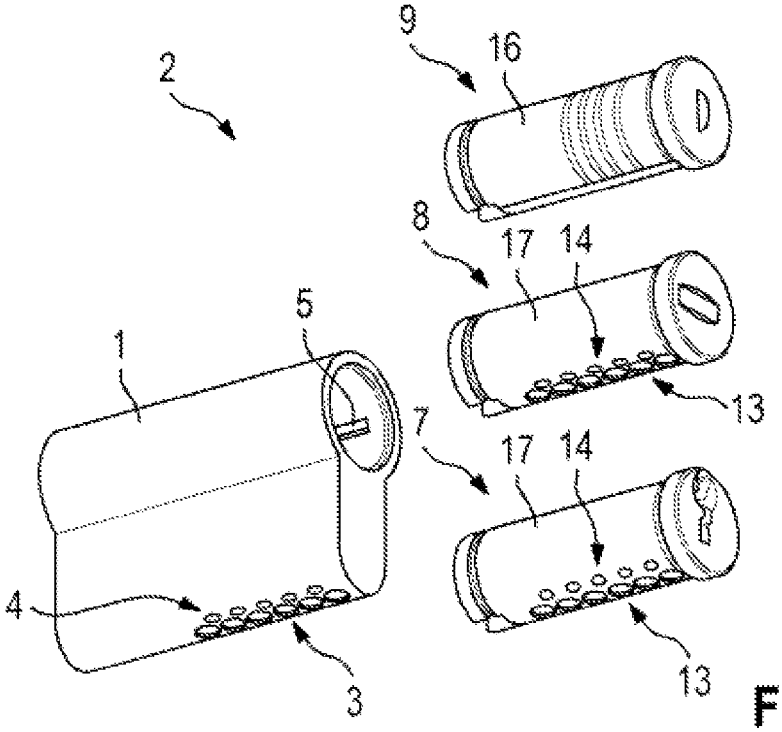
FIG. 4 is a schematic drawing showing the three exemplary embodiments of FIG. 3 from a different angle.

FIGS. 3 and 4 show a lock 2 according to three different exemplary embodiments. As shown in FIG. 3, the lock 2 can be manufactured for three different concepts. The first cylinder core 7 follows the Yale concept. The second cylinder core 8 follows the dimple key concept. The third cylinder core 9 follows the disk cylinder type concept. The three different cylinder cores 7, 8, 9 can be provided within the same cylinder body 1.

The first cylinder core 7 requires a Yale key 19, which has a saw tooth structure for adjusting the first core pin row 13. Only if the core pin row 13 is adjusted in the correct manner, the pin cylinder can be rotated by the Yale key 19 in order to move a lock cam (not shown) of the lock 2.

The second cylinder core 8 can be operated with a dimple key 20. The dimple key 20 comprises different drilled holes and milled slots within the key body, which adjust the first core pin row 13, the second core pin row 14 (FIG. 4), and the third core pin row 15. Only in case all these three pin rows 13, 14, 15 are adjusted in the correct manner, the pin cylinder 17 can be rotated with the dimple key 20.

Finally, the third cylinder core 9 comprises a locking bar 6, which can be operated by a disk key 21. The disk key 21 can rotate different disks provided within the disk cylinder 16 of the third cylinder core 9 to different angles. If all the disks are rotated to the correct angle, the locking bar 6 is completely inserted into the disk cylinder 16 of the third cylinder core 9, such that the disk cylinder 16 can be rotated within the cylinder body 1.

In the same way as the first cylinder core 7 can move a lock cam, the second cylinder core 8 and the third cylinder core 9 are also enabled to rotate the lock cam.

To further increase the security functions of the lock 2, all cylinder cores 7, 8, 9 comprise a magnetic pin 12 which aligns with a fourth pin channel 11. The fourth pin channel 11 is provided in parallel to the third pin channel 5. The magnetic pin 12 can only be unlocked in case the respective key 19, 20, 21 has the correct magnetic code. Therefore, illegal key copying can be prevented, as the illegally duplicated key cannot be used to unlock the magnetic pin 12.

Figure 5:
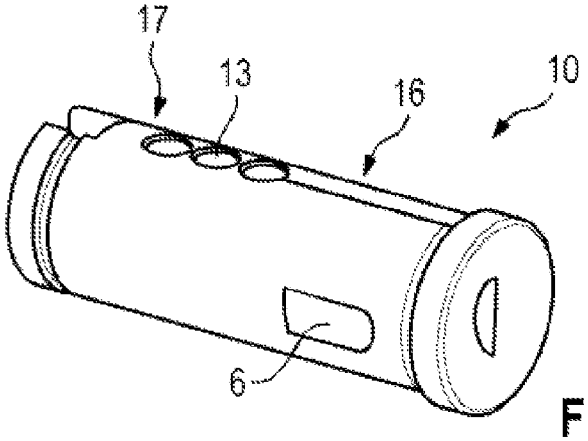
FIG. 5 is a schematic drawing showing another exemplary embodiment of the cylinder core which can be used within a lock according to the invention.
Figure 6:
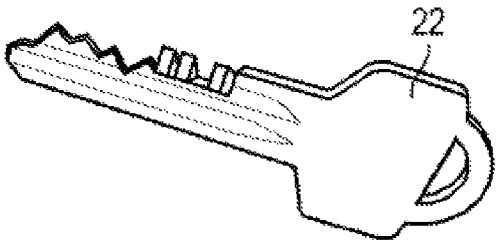
FIG. 6 is a schematic drawing showing a key which needs to be used for the cylinder core shown in FIG. 5.

FIG. 5 shows a fourth cylinder core 10 which can be employed within the cylinder body 1 to create a high security standard lock 2. The fourth cylinder core 10 comprises a disk cylinder 16 having the locking bar 6 and a pin cylinder 17 having the first core pin row 13. To operate the fourth cylinder core 10, a hybrid key 21 is needed, which is a combination of a Yale key and a disk key. Such a key is shown in FIG. 6.

Figure 7:
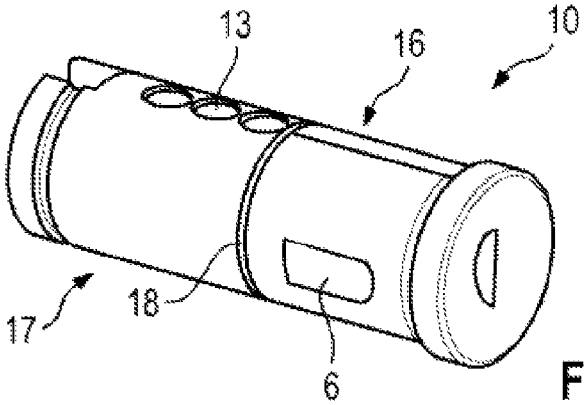
FIG. 7 is a schematic drawing showing the cylinder core of FIG. 5 in an alternative embodiment.

FIG. 7 shows an alternative embodiment of the fourth cylinder core 10. In the alternative embodiment, a coupling 18 is provided between the disk cylinder 16 and the pin cylinder 17. The coupling 18 allows rotation of the disk cylinder 16 relative to the pin cylinder 17 for about 20 degrees. Therefore, the hybrid key 22 can rotate the disks of the disk cylinder 16 in order to align the different disks of the disk cylinder 16 in a correct manner. Only if all the disks are adjusted in the correct manner, the locking bar 6 allows rotation of the disk cylinder 16. Therefore, the fourth cylinder core 10 can be rotated after unlocking the locking bar 6.

The fourth cylinder core 10 provides a security standard since it combines two different types of keys and locking concepts. The inventive cylinder body 1 does not need to be changed to provide such a specific type of cylinder core. Therefore, the cylinder body 1 can be employed in different manners such that various locks can be produced from the single cylinder body 1.

The invention claimed is:

1. Cylinder body for a cylinder for locks, comprising:

a body configured for receiving a first cylinder core;

at least a first pin channel and a second pin channel for guiding a plurality of core pins arranged on the first cylinder core;

at least one third pin channel for guiding a locking bar disposed on the cylinder core, wherein the third pin channel is oriented in a direction perpendicular to the first pin channel or the second pin channel; and at least a fourth pin channel configured for guiding a magnetic pin disposed on the cylinder core, the fourth pin channel being disposed in parallel to the third pin channel and being oriented in a direction perpendicular to the first pin channel or the second pin channel.

2. Cylinder body according to claim 1, wherein the first pin channel and the second pin channel are provided in parallel to each other.

3. Cylinder body according to claim 1, wherein the first pin channel is provided symmetric to the cylinder body and the second pin channel is provided asymmetric to the cylinder body.

4. Lock comprising a cylinder body according to claim 1, wherein the cylinder core disposed within the cylinder body includes at least one row of the plurality of core pins aligning with the first pin channel and/or the second pin channel.

5. Lock according to claim 1, wherein the cylinder core comprises at least one first row of core pins aligning with the first pin channel or at least one second row of core pins aligning with the second pin channel or a locking bar aligning with the third pin channel.

6. Lock according to claim 1, wherein the cylinder core is a disc cylinder configured for receiving a first key and further includes the locking bar or the cylinder core is a pin cylinder configured for receiving a second key and further includes at least the first row of core pins.

7. Lock according to claim 6, wherein the cylinder core includes a disc cylinder configured for receiving a first key and a pin cylinder configured for receiving a second key, wherein the disc cylinder further includes the locking bar and the cylinder core further includes at least the first row of core pins, and a coupling is provided between the disc cylinder and the pin cylinder.

* * * * *